US007056230B2

(12) United States Patent
Emalfarb

(10) Patent No.: US 7,056,230 B2
(45) Date of Patent: Jun. 6, 2006

(54) GOLF BALL WITH CHANGEABLE CHARACTERISTICS

(76) Inventor: Bradley S. Emalfarb, 763 Bunker Ct., Riverwoods, IL (US) 60015

( * ) Notice: Subject to any disclaimer, the term of this patent is extended or adjusted under 35 U.S.C. 154(b) by 100 days.

(21) Appl. No.: 10/025,396

(22) Filed: Dec. 18, 2001

(65) Prior Publication Data

US 2003/0114254 A1 Jun. 19, 2003

(51) Int. Cl.
*A63B 37/00* (2006.01)

(52) U.S. Cl. ..... 473/351

(58) Field of Classification Search ..... 473/353, 473/351, 352, 375, 377, 378, 358
See application file for complete search history.

(56) References Cited

U.S. PATENT DOCUMENTS 5,098,104 A 3/1992 Kane
5,447,314 A * 9/1995 Yamazaki et al. ..... 473/353
5,823,891 A * 10/1998 Winskowicz ..... 473/378
5,938,544 A * 8/1999 Winskowicz ..... 473/378
5,948,848 A 9/1999 Giltsoff
6,011,466 A * 1/2000 Goldman ..... 340/539.32
6,113,504 A * 9/2000 Kuesters ..... 473/353
6,211,325 B1 * 4/2001 Sun et al. ..... 528/66
6,277,037 B1 * 8/2001 Winskowicz et al. ..... 473/378
6,315,683 B1 * 11/2001 Yoshida et al. ..... 473/375
6,358,160 B1 * 3/2002 Winskowicz ..... 473/378
6,585,555 B1 * 7/2003 Wong et al. ..... 446/153
2002/0094885 A1 7/2002 Finkel

* cited by examiner

*Primary Examiner*—Raeann Gorden
(74) *Attorney, Agent, or Firm*—Wood, Phillips, Katz, Clark & Mortimer

(57) ABSTRACT

A golf ball having a body with a spherical outer surface having a first shape, first diameter, and first hardness which cooperatively cause the golf ball to have a first performance characteristic. At least a portion of the spherical outer surface is made from a material that changes from at least one of the first shape, first diameter, and first hardness upon being immersed in water continuously for a time period less than one hundred eighty days so that the golf ball has a second performance characteristic that is different than the first performance characteristic.

28 Claims, 3 Drawing Sheets

GOLF BALL WITH CHANGEABLE CHARACTERISTICS

BACKGROUND OF THE INVENTION

1. Field of the Invention

This invention relates to balls used for playing golf and, more particularly, to a golf ball that has characteristics that change upon being exposed continuously to a liquid, such as water, for a predetermined time period.

2. Background Art

The game of golf is enjoyed by persons in large numbers on a worldwide basis. A key source of revenue to golf equipment suppliers is the ball used to play golf. Golfers, and particularly golfers of average or lesser talent, commonly lose a significant number of balls in woods, water holes and elsewhere during a round. While clubs and other accessories may be purchased only once, or a limited number of times, during an individual's playing career, supplies of golf balls must be regularly replenished.

It is a common practice of golf facilities to recover golf balls that have been retrieved from water holes, woods, or other hazards, and to sell these secondhand balls for reuse. This practice significantly reduces the demand for new golf balls, potentially representing millions of dollars in lost sales for golf ball manufacturers.

More significantly, use of secondhand golf balls may adversely affect the reputation of golf ball manufacturers. Used golf balls may be marred or otherwise disfigured upon being struck improperly by a club and/or upon encountering a hard object during play in normal use. Further, the characteristics of a golf ball may be altered as a result of being submerged in water holes for extended periods. After extended submersion, certain golf balls may actually absorb water, which changes their weight and playing characteristics. Golf balls may also deteriorate as a result of being immersed in moist dirt, sand, etc. An individual playing with an altered ball may attribute poor performance characteristics to the golf ball design, rather than to the fact that the golf ball's characteristics have been changed. A golfer may be induced to change brands as a result of experiencing poor performance with a particular type of used golf ball.

Aside from the fact that the reputation of a golf ball manufacturer may be adversely affected by modified, used golf balls, play with such balls may detract from the effectiveness of one's play, which may diminish interest in the sport. The financial loss to the golf industry is potentially huge.

SUMMARY OF THE INVENTION

In one form, the invention is directed to a golf ball having a body with a spherical outer surface having a first shape, first diameter, and first hardness which cooperatively cause the golf ball to have a first performance characteristic. At least a portion of the spherical outer surface is made from a material that changes from at least one of the first shape, first diameter, and first hardness upon being immersed in water continuously for a time period less than one hundred eighty days so that the golf ball has a second performance characteristic that is different than the first performance characteristic.

In one form, the spherical outer surface has a plurality of dimples formed thereon.

The body may consist of a core and a cover layer around the core and defining the spherical outer surface.

In one form, the spherical outer surface has a radial dimension and the cover layer has a radial thickness that is not greater than one-third the radial dimension of the outer surface.

The material may define either the entirety or only a part of the spherical outer surface.

The material may be a polymer.

The time period within which the material changes may be less than thirty days.

In one form, the material changes by melting.

The invention is also directed to a golf ball having a body with a spherical outer surface, with the golf ball having a normal state in which the golf ball has a first performance characteristic. The body consists of a material that changes from a first state with the golf ball in its normal state into a second state as an incident of the golf ball being immersed in water continuously for a time period less than one hundred eighty days. With the material in the second state, the golf ball has a second performance characteristic that is different than the first performance characteristic.

In one form, the body has a core and a cover layer around the core, with the core being made up of the material.

In one form, a capillary communicates from the outer surface to the core.

The capillary may be hollow or have a degradable material therein.

In one form, the core consists of the material and the capillary communicates from the outer surface to the material.

The material may define only a portion of the core, either at its center or spaced from the center.

The invention is further directed to a golf ball having a body with a core and a cover layer with an outer surface. The body has at least one capillary communicating from the outer surface of the cover layer to the core.

The core may include a hollow portion in communication with the at least one capillary.

In one form, the capillary is at least partially filled with a material that changes from a first state into a second state as an incident of the ball being immersed in water continuously for a time period of less than 180 days.

In one form, the golf ball has a normal state in which the golf ball has a first performance characteristic. The core has a portion in communication with the at least one capillary that consists of a material that changes from a first state with the golf ball in the normal state into a second state as an incident of the golf ball being immersed in water continuously for a time period of less than 180 days. The material in the second state causes the golf ball to have a second performance characteristic that is different from the first performance characteristic.

The invention is also directed to a method of playing golf. The method includes the steps of providing a golf ball having a normal state wherein the golf ball has a first performance characteristic and a second state resulting from immersion of the golf ball in water for a time period less than one hundred eighty days, in which the golf ball has a second performance characteristic that is different than the first performance characteristic; striking the golf ball into an accumulation of water using a golf club; and allowing the ball to remain immersed in the accumulation of water sufficiently that the golf ball is caused by the water to change from the first state into the second state.

The time period may be less than thirty days.

DETAILED DESCRIPTION OF THE DRAWINGS

Figure 1:
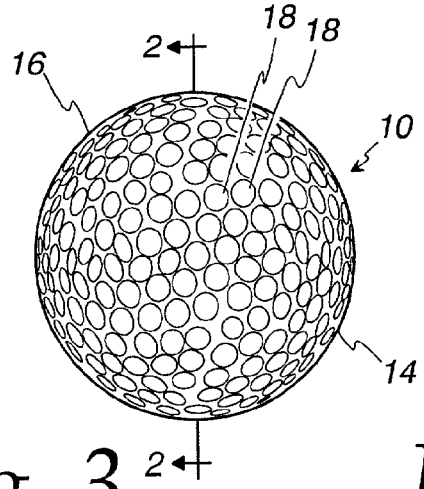
Fig. 1 (prior art)
FIG. 1 is an elevation view of a conventional golf ball.
Figure 2:
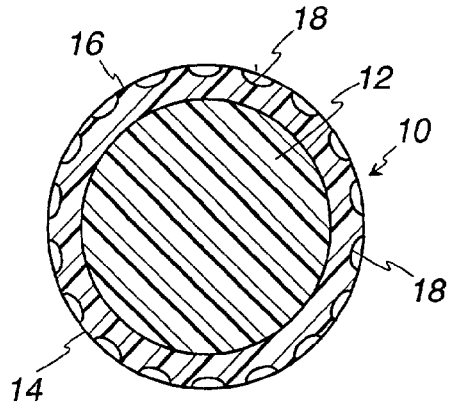
Fig. 2 (prior art)
FIG. 2 is a cross-sectional view of the golf ball taken along lines 2—2 of FIG. 1.

In FIGS. 1 and 2, a conventional golf ball is shown at 10. The golf ball 10 is shown strictly as an exemplary construction of a type within which the present invention can be incorporated. The golf ball 10 consists of a core 12 which is surrounded by a cover layer 14 defining a spherical outer surface 16 within which dimples 18 are formed. As noted above, the construction of the golf ball 10 is only exemplary of the myriad different designs that are currently used to play golf. As an example, the core 12 may vary significantly in terms of its diameter and composition, and may be made from a number of different layers or components.

A multitude of different core designs are currently used in the industry, with many more being researched. The core construction is not key to certain embodiments described herein. The material of the core shown in the various embodiments should not be viewed as limiting. The cover layer 14 may have a variety of different thicknesses and may be made from materials currently used to achieve desired durability and other desired performance characteristics. The dimples 18 shown are currently offered in different sizes, depth, shapes, densities, patterns, etc. over the outer surface 16. Typically, the cover layer 14, defining the spherical outer surface 16, is made from a material that is resistant to water permeation so that the golf ball 10 may be immersed in water for potentially a year or more without any significant alteration in the performance characteristic of the golf ball 10.

Figure 3:
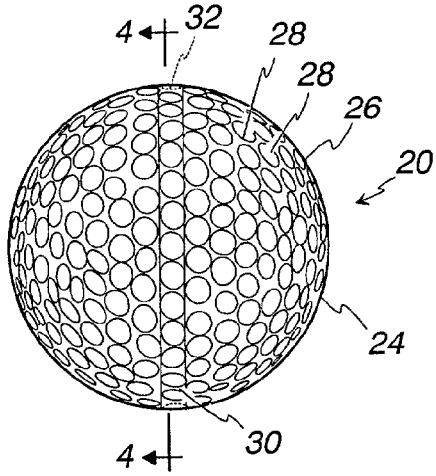
FIG. 3 is an elevation of one form of golf ball, according to the present invention, and incorporating a band of material in a cover layer thereon that is controllably degradable in water.
Figure 4:
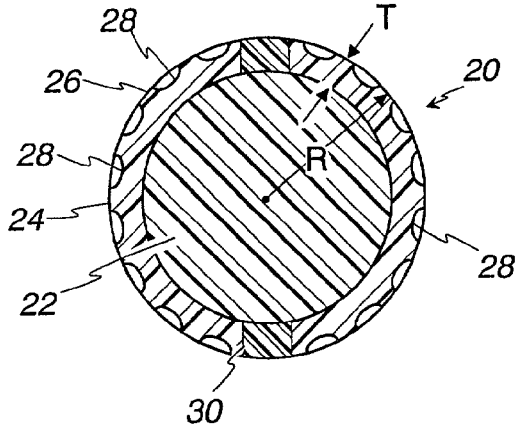
FIG. 4 is a cross-sectional view of the golf ball taken along the line 4—4 of FIG. 3.

One form of the invention is shown in FIGS. 3 and 4. The golf ball 20 in those figures is shown to have the same construction as the golf ball 10 in FIGS. 1 and 2. That is, the golf ball 20 has a body with a core 22 with a surrounding cover layer 24 defining a spherical outer surface 26 with dimples 28 formed therein. Typically, the cover layer 24 has a radial dimension, i.e., thickness T, that is substantially less than the radial dimension R of the outer surface 26. As an example, the thickness T may be no more than one-third the dimension R.

It is contemplated that the invention be used in the same manner with golf balls that are not perfectly round, i.e. elliptical or otherwise. Golf ball technology is developing at a rapid rate and it is conceivable that other than perfectly round shapes will be developed with improved aerodynamic characteristics. The description "spherical", as used herein, is intended to encompass golf balls that are both perfectly round and those that are not.

In this embodiment, a portion 30 of the cover layer 24 is defined by a material that is different than the material defining the remainder of the cover layer 24. In this embodiment the portion 30 is shown as a band extending continuously around the circumference of the golf ball 20. In this embodiment, the portion 30 extends fully through the thickness T of the cover layer 24.

According to the invention, the material defining the portion 30 is designed so that at least one of its shape, size and hardness is changed as an incident of being immersed in water for a period less than one hundred eighty days and as short as 2–3 days. This change may be such that the material flakes, chips, cracks, dissolves, or otherwise degrades or loses durability in a manner that the performance characteristics of the golf ball are noticeably altered. As one example of degradation, the material may melt under these conditions so that the exposed surface 32 of the material defining the portion 30 has a reduced diameter. As a result, the golf ball 20 has a changed shape such that it has a different performance characteristic than it has with the material in its original unmelted state. Consequently, once the material melts to a significant degree, the golf ball 20 may not be practically usable to play golf with or will be noticeably compromised in terms of its performance.

In actuality, the golf ball may be partially or fully immersed in damp soil as in a wooded area, in moist sand, in clear water, or in water with mud, silt, and organic growth therein. For purposes of this application, all of those conditions will be characterized as "immersion in water" or "being in the presence of water".

The nature of the material that changes shape and/or hardness may vary considerably. There currently exists in the area of polymer plastics knowledge of materials and manufacturing methods to produce a material with characteristics suitable for incorporation into a golf ball and which are changeable in the presence of water over a controlled time period. This type of material will be referred to as "degradable" below. As one example, plastics of this type are shown in U.S. Pat. No. 6,211,325, to Sun et al., which patent is incorporated herein by reference.

Generally, the material defining the portion 30 may be a resin-based material mixed with an additive. The additive amount is controllable to select the length of exposure to moisture, at which appreciable degradation occurs. The additive may be a starch-based degradable additive in an amount of 1–35%. Those skilled in the art will know how, and in what concentration, the additive should be mixed with the base resin to control degradation characteristics. A typical working range for the additive is 5–10%. The additive will typically be mixed in powder form with the resin. Of course, the components could be in any form, such as liquid or pellet form.

It is desirable that the hardness and/or dimension of the material change by immersion in water significantly within an immersion time period of less than one hundred eighty days, and more preferably one hundred twenty days. It may be more preferable to reduce this time period to thirty days, seven days, or even a matter of two or three days to avoid the possibility that golf course management might on a frequent basis recover golf balls from hazards for purposes of resale. It is of course important that the golf ball not have deteriorated properties and performance characteristics upon being exposed to water in the normal course of play, i.e., in rainy conditions or upon being only briefly immersed in a water hole and recovered during a round.

Figure 5:
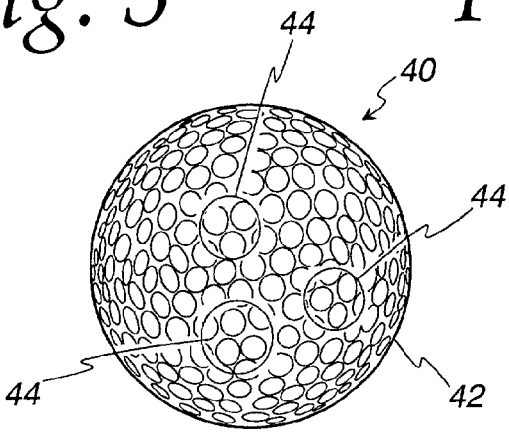
FIG. 5 is an elevation view of a modified form of golf ball, according to the present invention, and disclosing discrete portions of degradable material in a cover layer thereon.

In FIG. 5, a golf ball is shown at 40 having the same general construction as the golf balls 10, 20, with the exception that the degradable material is incorporated into the outer surface 42 thereof in discrete masses 44, in this case shown to be circular in shape.

Figure 6:
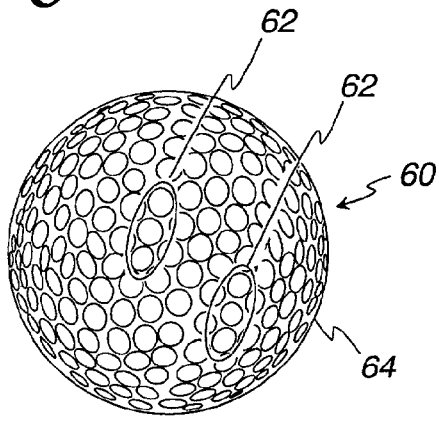
FIG. 6 is a view as in FIG. 5 showing different shapes of discrete portions of the degradable material contemplated by the invention.

In FIG. 6, a golf ball is shown at 60 of a construction similar to the golf ball 40, with the exception that the degradable material is incorporated in discrete portions 62 of an outer surface 64 and with the portions 62 taking an oval or elliptical shape.

Figure 7:
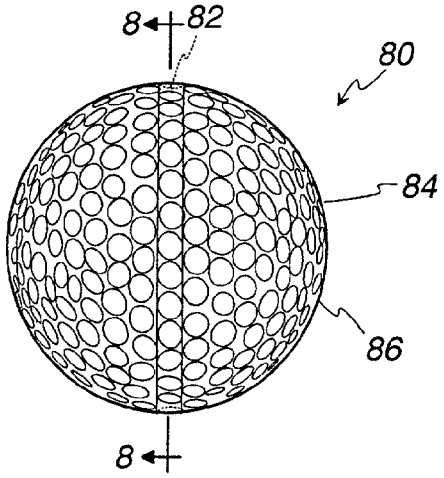
FIG. 7 is an elevation view of a further modified form of golf ball, according to the present invention, wherein degradable material is incorporated into the cover layer through less than the entire thickness thereof.
Figure 8:
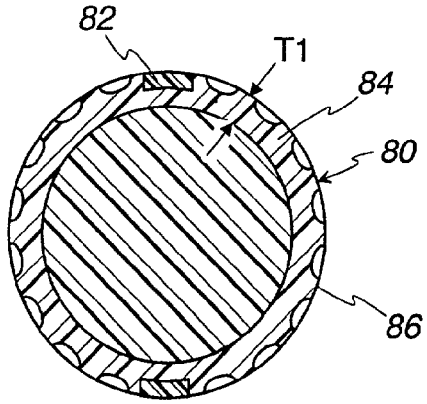
FIG. 8 is a cross-sectional view of the golf ball taken along lines 8—8 of FIG. 7.

In FIGS. 7 and 8, a golf ball 80 is shown having a construction similar to the golf ball 20, with the exception that the portion 82 defined by the degradable material is formed in a band which does not extend through the full thickness $T_1$ of the cover layer 84 defining an outer surface 86.

Figure 9:
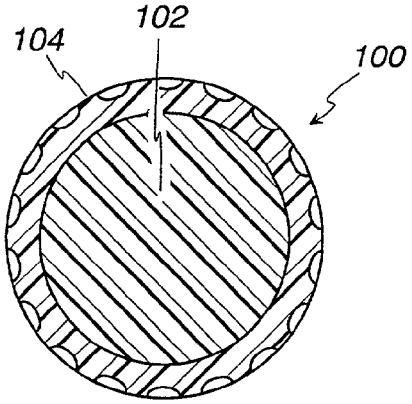
FIG. 9 is a cross-sectional view of a further modified form of golf ball, according to the present invention, wherein the entire cover layer is made from a material that is controllably degradable.

In FIG. 9, a golf ball is shown at 100 having a body and a core 102 and cover layer 104, with the cover layer 104 made entirely of the material which changes within the desired time period.

Figure 10:
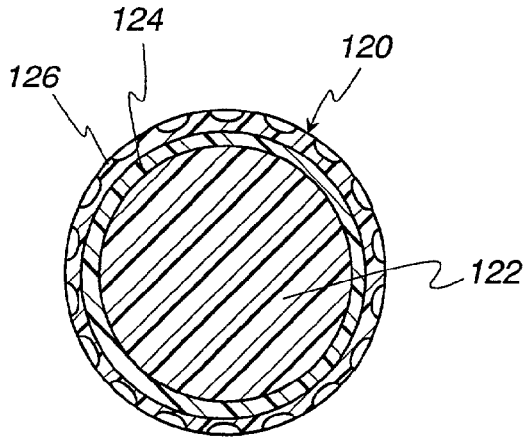
FIG. 10 is a cross-sectional view of a further modified form of golf ball, according to the present invention, including multiple cover layers.

In FIG. 10, a further modification is shown for a golf ball 120 having a body with a core 122, a surrounding layer 124 and a cover layer 126 surrounding the layer 124. Only the cover layer 126 is made from the material that degrades in water to the extent desired in the desired time period.

Of course, the entire golf ball can be formed as a solid mass made from the degradable material.

Figure 12:
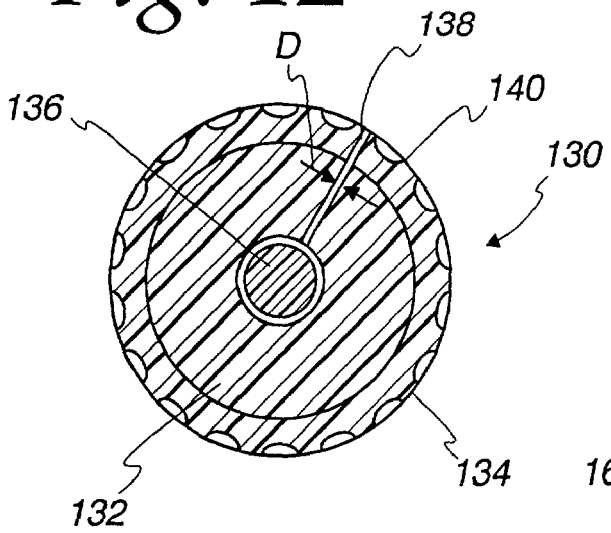
FIG. 12 is a cross-sectional view of a further modified form of golf ball, according to the present invention, wherein moisture migrates through a capillary to a part of the core that is degradable in the presence of moisture.

A further modified form of golf ball, according to the present invention, is shown at FIG. 12 at 130. The golf ball 130 has a body with a core 132 and a cover layer 134 surrounding the core 132. The core 132 has a central portion 136 that is made from a material that is degradable in the presence of moisture. A capillary 138 communicates from an external surface 140 of the cover layer 134 to the central portion 136 of the core 132. The capillary 138 has a diameter D chosen so that with the golf ball 130 immersed in a liquid, the time for the liquid to migrate fully to the central portion 136 can be controlled to be within the desired range, previously described, i.e. less than 180 days.

Figure 13:
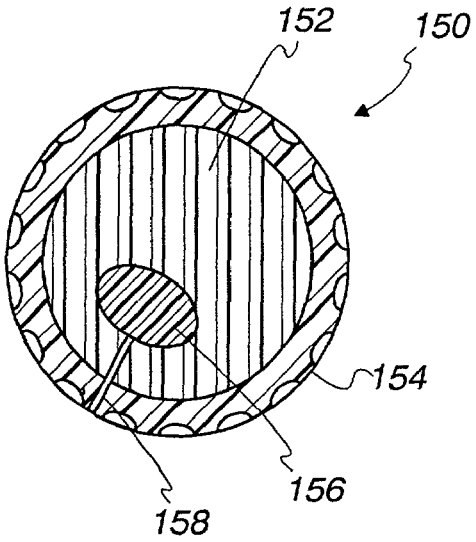
FIG. 13 is a cross-sectional view of a golf ball, according to the invention and as in FIG. 12, with a core part, to which moisture can migrate, having a different shape and location.

In FIG. 13, a modified form of golf ball, according to the present invention, is shown at 150. The golf ball 150 is of similar construction to the golf ball 130, having a body with a core 152, a cover layer 154 surrounding the core 152, a central core portion 156, and a capillary 158 communicating to the central core portion 156. This embodiment differs primarily in the shape and location of the central core portion 156. Whereas in the prior embodiment the core portion 136 has a generally centered location, the core portion 156 is set outwardly from the center location. Additionally, whereas the core portion 136 is shown with a round shape, the core portion 156 has an elliptical shape.

The core portions can have virtually any shape and location. Multiple core portions could be incorporated with a like number of capillaries. Further, multiple capillaries could be used to communicate with each core portion or multiple core portions.

Figure 14:
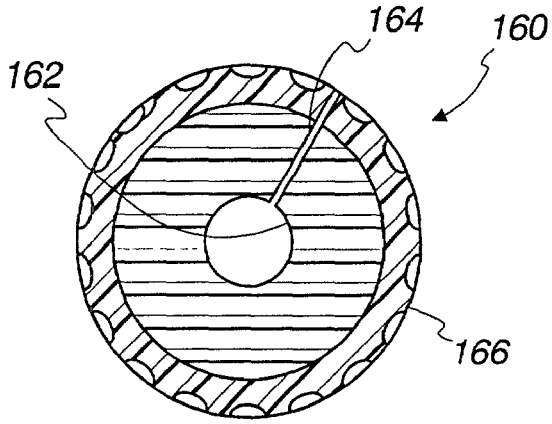
FIG. 14 is a cross-sectional view of a modified form of golf ball, according to the present invention, and utilizing a capillary through which moisture migrates to a hollow space in the core.

In FIG. 14, a further modified form of golf ball, according to the present invention, is shown at 160. The golf ball 160 is similar to the golf ball 130, show in FIG. 12, with the exception that a central core portion 162 is hollow. Moisture migrating through a capillary 164 from the external surface 166 communicates to the hollow core portion 162 and is accumulated thereat to thereby alter the playing characteristics of the ball 160 in a manner that is noticeable upon being struck by a golf club.

Figure 15:
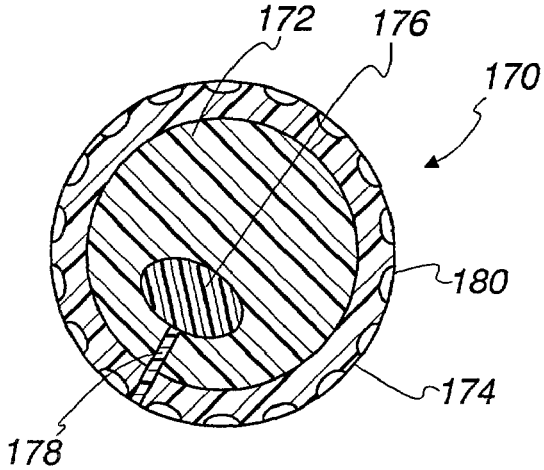
FIG. 15 is a cross-sectional view of a still further modified form of golf ball, according to the present invention, and utilizing a capillary that has a degradable material therein.

In FIG. 15, a further modified form of golf ball, according to the present invention, is shown at 170. The golf ball 170 has a body with a core 172 surrounded by a cover layer 174. The core 172 includes a core portion 176 that is made from a degradable material. A capillary 178 communicates from an external surface 180 of the cover layer 174 to the core part 176. The capillary 178 is filled with a degradable material 182. Accordingly, the effective diameter of the capillary 178, the material therein, and the length of the capillary 178 can be controlled, together with the characteristics of the material in the core part 176, to select the "useful life" of the golf ball 170.

Figure 11:
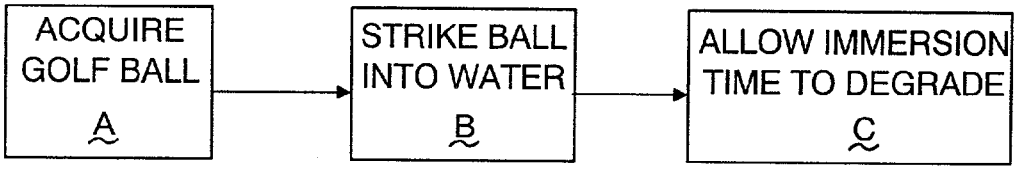
FIG. 11 is a schematic representation of a method of playing golf, using a golf ball according to the present invention.

As shown schematically in FIG. 11, using golf balls, made according to the present invention, a user can acquire a golf ball as indicated by the block A, strike the ball with a club into water, as shown at the block B, and allow the immersed ball to remain in the water for a sufficient length of time that the material defining part or all of the cover layer thereof degrades to the point that the performance characteristics of the golf ball are compromised, as shown at the block C.

The foregoing disclosure of specific embodiments is intended to be illustrative of the broad concepts comprehended by the invention.

The invention claimed is:

1. A golf ball comprising:

a body comprising a spherical outer surface having a first shape, first diameter, and first hardness which cooperatively cause the golf ball to have a first performance characteristic;

at least a portion of the spherical outer surface comprising a material that changes from at least one of the first shape, first diameter, and first hardness upon being immersed in water continuously for a time period less than one hundred eighty days so that the golf ball has a second performance characteristic that is different than the first performance characteristic, said portion of the spherical outer surface maintaining the at least one of the first shape, first diameter, and first hardness such that the golf ball does not undergo a change from the first performance characteristic with the golf ball exposed to water for the duration of a round of golf, a difference between the first and second performance characteristic being such that the golf ball with the second performance characteristic is not practically usable to play golf with.

2. The golf ball according to claim 1 wherein the spherical outer surface has a plurality of dimples formed thereon.

3. The golf ball according to claim 1 wherein the body comprises a core and a cover layer around the core and defining the spherical outer surface.

4. The golf ball according to claim 1 wherein the spherical outer surface has a radial dimension and the cover layer has a radial thickness that is not greater than one-third the radial dimension of the spherical outer surface.

5. The golf ball according to claim 1 wherein the material defines the entire spherical outer surface.

6. The golf ball according to claim 1 wherein the material defines less than the entire spherical outer surface.

7. The golf ball according to claim 1 wherein the material comprises a polymer.

8. The golf ball according to claim 1 wherein the time period is less than thirty days.

9. The golf ball according to claim 1, wherein the material changes from the at least one of the first shape, first diameter, and first hardness by melting.

10. A golf ball comprising:

a body comprising a spherical outer surface, the golf ball having a normal state in which the golf ball has a first performance characteristic, the body comprising a material that changes from a first state with the golf ball in the normal state into a second state as an incident of the golf ball being immersed in water continuously for a time period less than one hundred eighty days, the material in the second state causing the golf ball to have a second performance characteristic that is different than the first performance characteristic such that the golf ball with the second performance characteristic is not practically usable to play golf with, the material maintaining the first state upon being exposed to water for the duration of a round of golf.

11. The golf ball according to claim 10 wherein the material changes from the first state into the second state by melting.

12. The golf ball according to claim 11 wherein the spherical outer surface has a plurality of dimples formed thereon.

13. The golf ball according to claim 10 wherein the body comprises a core and a cover layer around the core and defining the spherical outer surface.

14. The golf ball according to claim 13 wherein the spherical outer surface has a radial dimension and the cover layer has a radial dimension that is not greater than one-third the radial dimension of the spherical outer surface.

15. The golf ball according to claim 13 wherein the material defines the entire spherical outer surface.

16. The golf ball according to claim 13 wherein the material defines less than the entire spherical outer surface.

17. The golf ball according to claim 10 wherein the material comprises a polymer.

18. A golf ball comprising:

a body comprising a spherical outer surface, the golf ball having a normal state in which the golf ball has a first performance characteristic, the body comprising a material that changes from a first state with the golf ball in the normal state into a second state as an incident of the golf ball being immersed in water continuously for a time period less than one hundred eighty days, the golf ball maintaining the first performance characteristic with the golf ball exposed to water for the duration of a round of golf, the material in the second state causing the golf ball to have a second performance characteristic that is different than the first performance characteristic to the point that the golf ball with the second performance characteristic is not practically usable to play golf with, wherein the body comprises a core and a cover layer around the core and the core comprises the material.

19. A golf ball comprising:

a body comprising a spherical outer surface, the golf ball having a normal state in which the golf ball has a first performance characteristic, the body comprising a material that changes from a first stage with the golf ball in the normal state into a second state as an incident of the golf ball being immersed in water continuously for a time period less than one hundred eighty days, the material in the second state causing the golf ball to have a second performance characteristic that is different than the first performance characteristic, wherein the body comprises a core and a cover layer with an outer surface and further comprising a capillary communication from the outer surface to the core.

20. The golf ball according to claim 19 wherein the capillary has a degradable material therein.

21. The golf ball according to claim 19 wherein the core comprises the material and the capillary communicates from the outer surface to the material.

22. The golf ball according to claim 21 wherein the material defines only a portion of the core.

23. The golf ball according to claim 22 wherein the core has a center and the portion of the core is at the center of the core.

24. The golf ball according to claim 22 wherein the core has a center and the portion of the core is spaced from the center of the core.

25. A golf ball comprising:

a body comprising a core and a cover layer with an outer surface, the body comprising at least one capillary communicating from the outer surface of the cover layer through the cover layer to the core, wherein the at least one capillary has a material filling at least a part of the at least one capillary in the cover layer with a material that is different than a material defining the cover layer.

26. The golf ball according to claim 25 wherein the core comprises a hollow portion in communication with the at least one capillary.

27. A golf ball comprising:

a body comprising a core and a cover layer with an outer surface, the cover layer defined by a first material, the body comprising at least one capillary communicating from the outer surface of the cover layer to the core, wherein the capillary is at least partially filled with a second material that is different than the first material and changes from a first state into a second state as an incident of the ball being immersed in water continuously for a time period that is less than one hundred eighty days.

28. A golf ball comprising:

a body comprising a core and a cover layer with an outer surface, the cover layer defined by a first material, the body comprising at least one capillary communicating from the outer surface of the cover layer to the core, wherein the golf ball has a normal state in which the golf has a first performance characteristic, the core comprises a portion in communication with the at least one capillary that comprises a second material that changes from a first state with the golf ball in the normal state into a second state as an incident of the golf ball being immersed in water continuously for a time period that is less than one hundred eighty days, the second material in the second state causing the golf ball to have a second performance characteristic that is different than the first performance characteristic.

* * * * *